US005253021A

United States Patent [19]

Aslam et al.

[11] Patent Number: 5,253,021

[45] Date of Patent: Oct. 12, 1993

[54] METHOD AND APPARATUS OF TRANSFERRING TONER IMAGES MADE UP OF SMALL DRY PARTICLES

[75] Inventors: Muhammad Aslam; Lawrence P. DeMejo; Alec N. Mutz, all of Rochester; John M. McCabe, Pittsford, all of N.Y.

[73] Assignee: Eastman Kodak Company, Rochester, N.Y.

[21] Appl. No.: 843,664

[22] Filed: Feb. 28, 1992

[51] Int. Cl.[5] ..... G03G 15/16

[52] U.S. Cl. ..... 355/271; 355/285; 355/327; 355/290; 430/33; 430/124

[58] Field of Search ..... 355/290, 289, 285, 326, 355/282, 271, 272, 327; 430/124, 33; 118/59, 60; 219/216, 388; 432/60

[56] References Cited

U.S. PATENT DOCUMENTS

| | | | |
|---|---|---|---|
| 3,893,761 | 7/1975 | Buchan et al. | 118/106 X |
| 3,923,392 | 12/1975 | Buchan et al. . | |
| 3,947,113 | 3/1976 | Buchan et al. . | |
| 4,068,937 | 1/1978 | Willemse et al. . | |
| 4,453,820 | 6/1984 | Suzuki . | |
| 4,531,825 | 7/1985 | Miwa et al. . | |
| 4,542,978 | 9/1985 | Tarumi et al. . | |
| 4,585,319 | 4/1986 | Okamoto et al. | 219/216 X |
| 4,588,279 | 5/1986 | Fukuchi et al. . | |
| 4,657,373 | 4/1987 | Winthaegen et al. . | |
| 4,690,539 | 9/1987 | Radulski et al. | 118/645 X |
| 4,708,460 | 11/1987 | Langdon . | |
| 4,737,433 | 4/1988 | Rimai et al. | 430/111 |
| 4,833,060 | 5/1989 | Nair et al. | 430/137 |
| 4,910,558 | 3/1990 | Giezeman et al. | 355/279 |
| 4,912,514 | 3/1990 | Mizutani | 355/272 |
| 4,927,727 | 5/1990 | Rimai et al. | 430/99 |
| 4,931,839 | 6/1990 | Tompkins et al. | 355/277 |
| 4,968,578 | 11/1990 | Light et al. | 430/126 |
| 4,984,026 | 1/1991 | Nishise et al. | 355/271 X |
| 4,992,833 | 2/1991 | Derimiggio | 355/271 X |
| 5,021,835 | 6/1991 | Johnson | 355/271 |
| 5,053,827 | 10/1991 | Tompkins et al. | 355/271 |

FOREIGN PATENT DOCUMENTS 1-179181 7/1989 Japan .

*Primary Examiner*—Richard L. Moses
*Attorney, Agent, or Firm*—Leonard W. Treash

[57] ABSTRACT

Small particle toner images carried on an image member are transferred to thermally conductive intermediate by heating the intermediate in the presence of an electrical field urging transfer. The intermediate is heated to a temperature sufficient to sinter the toner particles at least when they touch the intermediate and other toner particles, but insufficient to damage the image member or cause the toner to stick to the image member. The toner image is transferred from the intermediate to a receiving sheet, which step can include sufficient heat and pressure to fix the image to the receiving sheet.

35 Claims, 3 Drawing Sheets

METHOD AND APPARATUS OF TRANSFERRING TONER IMAGES MADE UP OF SMALL DRY PARTICLES

RELATED APPLICATIONS

This application is related to co-assigned:

U.S. patent application Ser. No. 07/843666, filed Feb. 28, 1993, IMAGE-FORMING METHOD AND APPARATUS USING AN INTERMEDIATE, in the name of Aslam et al.

TECHNICAL FIELD

This invention relates to the transfer of images made up of small, dry toner particles. Although not limited thereto, the invention is particularly usable in forming a multicolor image on an intermediate by heat assisted transfer, in registration, of more than one single color toner image.

BACKGROUND ART

The transfer of small, dry toner particles, for example, toner particles of less than 5 microns in size from a photoconductor or other image member to a receiving sheet is extremely challenging. Studies on the forces which move small particles indicate that as the particle becomes smaller the effect of an electrostatic field is less on a particle compared to the effect of ordinary adhesive forces. This has made conventional transfer using an electrostatic field relatively ineffective in transferring such small particles. See, U.S. Pat. No. 5,084,735. Rimai et al, issued Jan. 28, 1992 and U.S. Pat. No. 4,737,433, Rimai et al.

U.S. Pat. No. 4,968,578, Light et al, issued Nov. 6, 1990; U.S. Pat. No. 4,927,727, Rimai et al, issued May 22, 1990; and U.S. Pat. No. 5,021,835, Johnson, issued Jun. 4, 1991, all describe a heat assisted toner image transfer method particularly usable with small particles. Two or more single color images are transferred in registration from an image member to a receiving sheet by heating the receiving sheet to an elevated temperature. The temperature of the receiving sheet is sufficiently high that the toner sticks to the receiving sheet and to itself. Preferably, the receiving sheet is heated from inside a transfer drum to which it is secured. The transfer drum and image member form a pressure nip with the combination of heat and pressure transferring the image. This method is particularly useful in transferring extremely small, dry toner particles, for example, toner particles having a mean particle diameter of less than 5 microns.

In a preferred form of the heat assisted transfer described in these references a receiving sheet having a heat-softenable outer layer is used. The receiving sheet is heated to a temperature which softens the outer layer and the first layer or layers of the toner images partially embed themselves in the heat-softened layer to assist in transfer of the first image or so. Further layers of toner from subsequent images or dense portions of the first image attach themselves to toner particles that are partially embedded. With extremely small, dry toner particles this method provides extremely efficient transfer with excellent resolution.

Although heat assisted transfer to a heat-softened layer provides the most efficient and highest resolution transfer of very small toner particles known in the prior art, it is not without problems. Depending somewhat on the materials, relatively high pressures are desirable, for example, pressures of up to 500 pounds per square inch and higher. Heating is accomplished generally through the receiving sheet. Even if the receiving sheet is carried on a metallic drum, it is somewhat difficult to maintain the temperature of the thermoplastic layer within limits that will sinter the toner without overheating the image member or blistering the receiving sheet. Overheating of the image member can cause damage to it, including a reduction of its ability to hold a charge. Overheating of the toner image can cause sticking to the image member and/or spreading of the image. It is known to provide a heating element inside a photoconductive drum which heats the drum to an elevated but safe temperature for the image member and thereby requires less heating from the transfer member. Even with this useful approach, temperature control at transfer is difficult with a receiving sheet receiving the images from a photoconductor.

An intermediate transfer member (sometimes herein called an "intermediate") has been used in both single color electrophotography and multicolor electrophotography. For example, U.S. Pat. No. 4,931,839, shows the use of an intermediate conductivity intermediate web to accumulate several single color toner images by separate electrostatic transfer from a photoconductive web. The multicolor image formed on the intermediate is electrostatically transferred to a receiving sheet and later fed to a separate fixing station. See also, U.S. Pat. Nos. 4,657,373; 4,068,937; 3,893,761; 4,453,820; and 4,542,978. In each of these references, the intermediate has a silicone rubber or other compliant surface which is used because of its affinity to toner at the first transfer step. At or before the second transfer step the image and, in some instances, the receiving sheet are preheated so that transfer and fusing can be accomplished in a single step. The intermediate is generally cooled before it returns to the original image member to pick up additional images for fear of damage to a photoconductor or other sensitive portion of the original image member.

U.S. Pat. No. 4,910,558 shows an intermediate drum which is internally heated and covered with compressible silicone rubber.

U.S. Pat. No. 4,912,514 shows an intermediate web with a conductive base and a fluoride coating with separate rapid heating components opposite the original transfer from a photoconductive drum and opposite a combination transfer-fusing position where the single image is transferred to and fused to a receiving sheet. The first transfer is said in the reference to involve fusing the toner on a photosensitive drum until it transfers to and is temporarily fixed on the surface of the intermediate.

U.S. Pat. No. 4,531,825 shows an intermediate roller having a heat conductive core with a silicone or fluoride resin coating. The original image member has a soft backing providing a larger nip for the first transfer.

U.S. Pat. No. 4,992,833 shows an intermediate sheet or web to which a single toner image is transferred by means not described. After the transfer the image is fused to the intermediate and kept warm until overlaid with a receiving sheet.

U.S. Pat. No. 5,110,702, issued May 5, 1992 (CIP of U.S. patent application Ser. No. 448,487, now abandoned) to Y. Ng discloses using thermally assisted transfer for three or four small particle color toner transfers to an intermediate.

Japanese Kokai 1-179181; published Jul. 17, 1989, shows a combination of heat and electric field used to transfer a toner image to a receiving sheet carried by either a drum or belt.

SUMMARY OF THE INVENTION

It is an object of the invention to transfer a small particle toner image using heat assisted transfer, but with a method and apparatus in which parameters of heat and pressure are more easy to control.

This and other objects are accomplished by a method and apparatus in which a small particle toner image is formed on an image member. The image is transferred to a transfer surface of a conductive, preferably metallic, intermediate member by a combination of heat and electrostatic field.

In preferred embodiments, transfer efficiency comparable to that with a heat softenable receiver is achieved but without the sensitivity to heat and pressure variations of the prior process. Risk of damage to the image member from heat and pressure is substantially reduced.

According to a preferred embodiment, a plurality of different color, single color toner images are formed on one or more image members with small, dry toner particles, i.e., toner particles averaging less than 5 microns in diameter (for example, about 3.5 microns). The toner images are transferred in registration by contact with a metallic intermediate. The metallic intermediate is heated to a temperature sufficient to sinter the toner at least where it touches the intermediate and where toner particles touch each other. An electrical field is applied, enhancing transfer of the toner to the intermediate to form a multicolor toner image. The multicolor image can be transferred from the intermediate to a receiving sheet.

DESCRIPTION OF THE PREFERRED EMBODIMENTS

FIGS. 1, 3, 4 and 5 illustrate alternative image forming apparatus using toner image transfer intermediates. Preferably, each of the intermediates is conductive and image transfer to the intermediates is accomplished in the presence of heat and an electric field according to a process described more thoroughly below. The image on the intermediate is transferred and fused in a single step to a receiving sheet and the receiving sheet and intermediate are maintained in contact until the image is cooled sufficiently for separation without offset.

The method and apparatus disclosed herein can be used with receiving sheets made of ordinary paper, transparency stock, highly finished paper and the like. However, the best results are obtained if the receiving sheet has a heat-softenable thermoplastic outer surface to which the image is transferred.

The apparatus will be described first and the process of transferring toner images to the intermediate will be described later. The scope of the invention is defined in the claims.

Figure 1:
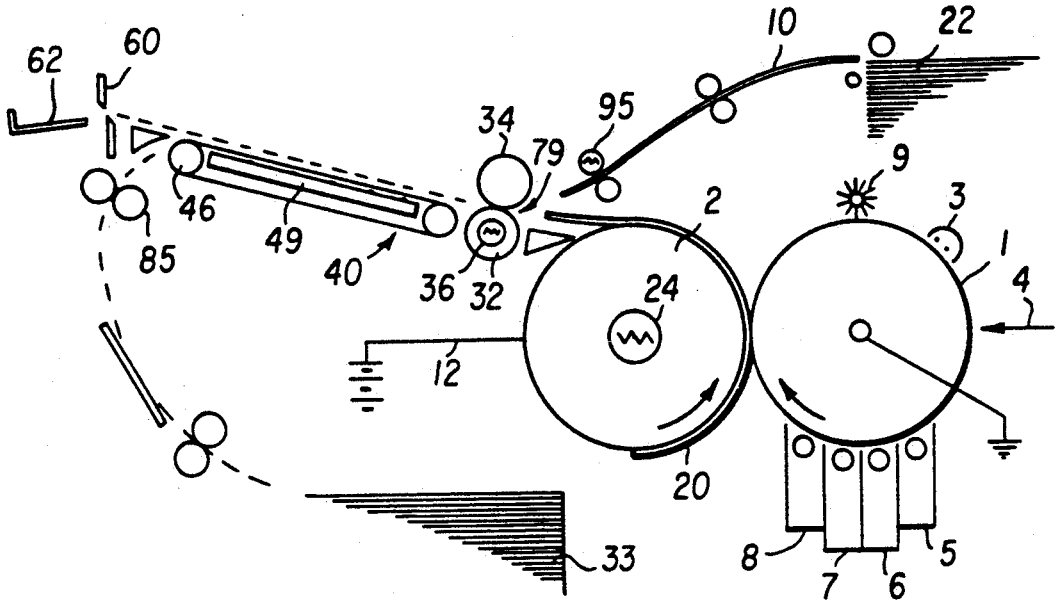
FIG. 1 is a side schematic of a multicolor image forming apparatus.

According to FIG. 1, an image member upon which electrostatic images can be formed can be of a variety or type including a drum or a belt. As shown in FIG. 1, an image member 1 is a drum which includes a photoconductive outer surface and which is rotatable past a series of stations. The stations include a charging station 3 which uniformly charges the photoconductive surface. A series of electrostatic images are formed by a suitable exposure means, for example, a laser 4, to create a series of electrostatic images on the photoconductive surface of image member 1. Each of the electrostatic images is toned by one of toning stations 5, 6, 7 or 8 to create a series of toner images. Toning stations 5, 6, 7 and 8 include toners of different colors, so that the series of electrostatic images are turned into a series of different color toner images. The electrostatic images could be formed by other methods, for example, non-electrophotographically by imagewise ion deposition.

An intermediate sheet 20 is fed out of an intermediate sheet supply 33 to the periphery of a transfer drum 2 where it is held by a vacuum, gripping fingers or other means. Drum 2 (which could also be an endless belt) is rotated a number of times to bring intermediate sheet 20 through transfer relation with the toner images carried on image member 1. Each toner image is transferred to intermediate sheet 20 on a separate revolution of drum 2 to overlay the toner images in registration to form a multicolor toner image. This transfer is assisted by heat from lamp 24 and an electrical field from a source of potential 12 urging transfer of the toner images to the intermediate sheet 20.

Intermediate sheet 20 is preferably conductive. For example, it can be made entirely of nickel from 3 to 10 mils in thickness. The surface of intermediate sheet 20 receiving the toner images is made hard and smooth. Drum 2 is also preferably metallic, allowing good conduction of heat from lamp 24 and also of the bias from potential source 12.

To provide a width of nip between image member 1 and intermediate sheet 20, image member 1 can include a compliant layer underneath suitable photoconductive and conductive layers. For example, image member 1 can be an aluminum drum to which is attached a thin compliant silicone rubber or other material and on top of which is stretched a web or sheet photoconductor having a grounded conductive backing layer. Transfer from image member 1 to intermediate sheet 20 can also be assisted by moderately heating image member 1 internally. However, as will be described later, this does not appear to be necessary using a metallic intermediate.

After more than one image has been transferred in registration to intermediate sheet 20 to form a desired multicolor image, a wedge or skive 15 is activated and moved into contact with drum 2 to separate intermediate sheet 20 therefrom. A receiving sheet 10 is fed from a receiving sheet supply 22 into overlying relation with the image on intermediate sheet 20 as these sheets enter a nip 79 between pressure rollers 32 and 34. At least one of the pressure rollers, for example, roller 32 is heated internally by a lamp 36 and sufficient pressure is applied between the rollers to effect transfer of the multicolor toner image to the receiving sheet.

Intermediate 20 and receiving sheet 10 form a sandwich which is fed by rollers 32 and 34 onto a transport 40 for transport away from heating lamps 36 and 24. Once free of rollers 32 and 34, the sandwich can be stopped while it cools or moved much slower by transport 40 allowing cooling at a slower speed which greatly shortens the path required for such cooling. During transport by transport 40 sheets 20 and 10 can be cooled by a forced air cooling mechanism 49 located inside transport 40. A cooling mechanism can also be located on the opposite side of the sandwich. Much greater flexibility in cooling is available with the sandwich not forced to move at the same speed as drum 2 and rollers 32 and 34.

Figure 2:
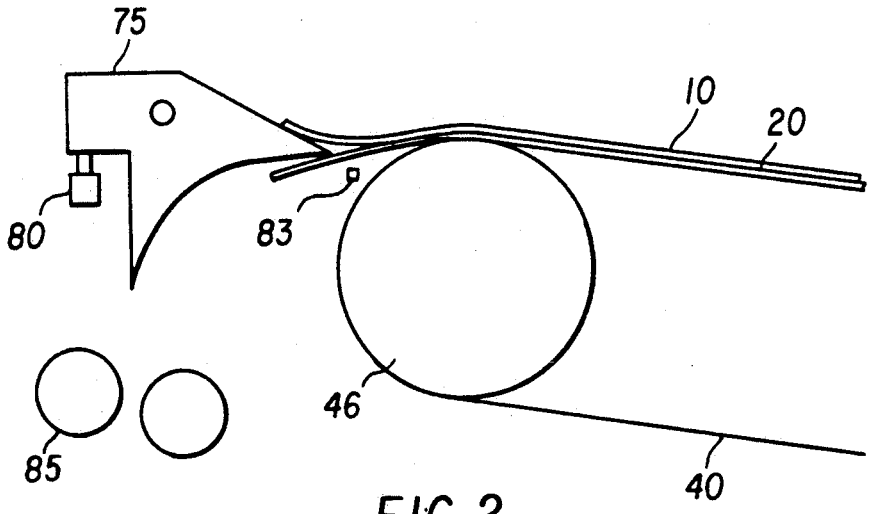
FIG. 2 is a side schematic of a portion of the apparatus shown in FIG. 1 illustrating the separation of intermediate and receiving sheets.

Once the toner image has been cooled below its glass transition temperature, the receiving sheet 10 is separated from the intermediate sheet 20 by a mechanism shown more clearly in FIG. 2. The leading edge of receiving sheet 10 is fed into nip 79 slightly behind the leading edge of intermediate 20. This feature is used in separation. Referring to FIG. 2, transport 40 includes a transport roller 46. As transport 40 moves the leading edges of receiving sheet 10 and intermediate sheet 20 past transport roller 46 the leading edge of sheet 20 is sensed by an optical or other suitable sensor 83. A separation pawl 75 is actuated by a solenoid 80 in response to sensor 83 to rotate clockwise into the leading portion of intermediate sheet 20 prior to arrival of the leading edge of receiving sheet 10. Pawl 75 substantially deflects intermediate sheet 20 from its path. The toner image having cooled below its glass transition temperature no longer holds these sheets together and the stiffness or beam strength of the receiving sheet 10 causes the two sheets to separate with the receiving sheet going above separation pawl 75 and the intermediate sheet 20 going below.

The receiving sheet 10 progresses on to be further treated. For example, it can be texturized at a station, not shown, or cut at a cutting station 60 and ultimately placed in an output hopper 62. Meanwhile, intermediate sheet 20 proceeds into transport rollers 85 which ultimately feed it along a path back to intermediate sheet supply 33.

For highest quality work, receiving sheet 10 has a heat-softenable thermoplastic outer layer on its bottom side as seen in FIG. 1. The thermoplastic outer layer can be preheated by any suitable means, for example, by passing between a pair of rollers 95, one of which is heated or by a suitable shoe contacting the backside of receiving sheet 10 immediately before it enters nip 79. The thermoplastic outer layer is heated to its softening point either by the preheating device or by contact with intermediate 20 or by rollers 32 and 34 or a combination of these. The toner image is at least partially embedded in the thermoplastic layer as the sheets 10 and 20 pass between rollers 32 and 34 with any toner not so embedded leveled by pressure and heat in the same process. Because much of the toner is embedded rather than being spread by rollers 32 and 34 and because there is thermoplastic across the entire surface, both higher resolution and better gloss is obtained than without the heat-softenable layer. This surface can be textured or additional gloss applied to it in a subsequent treatment step after the receiving sheet 10 has been separated from intermediate 20, as is known in the art.

With this structure, drum 2 is moving at full machine speed at all times, for example, four inches per second. Pressure rollers 32 and 34 also would operate at the same speed as drum 2. This allows these rollers to be positioned adjacent drum 2 without a slack box or loop between drum 2 and rollers 32 and 34. Transport 40 can then be operated at one inch per second or slower or be stopped allowing the sandwich to cool adequately without slowing drum 2. With rollers 32 and 34 positioned close to drum 2, most of the heat passed to intermediate 20 by drum 2 is not lost. The overall result is a much more compact and heatefficient apparatus than if a fusing belt were used for both the fixing and cooling steps. (Compare, for example, the structure shown in FIG. 5.)

Although intermediate sheet 20 and receiving sheet 10 can be fed into nip 79 with pressure rollers 32 and 34 permanently urged together, better results are obtained if these rollers are separated and moved together as the beginning of receiving sheet 10 reaches the center of the nip.

Figure 3:
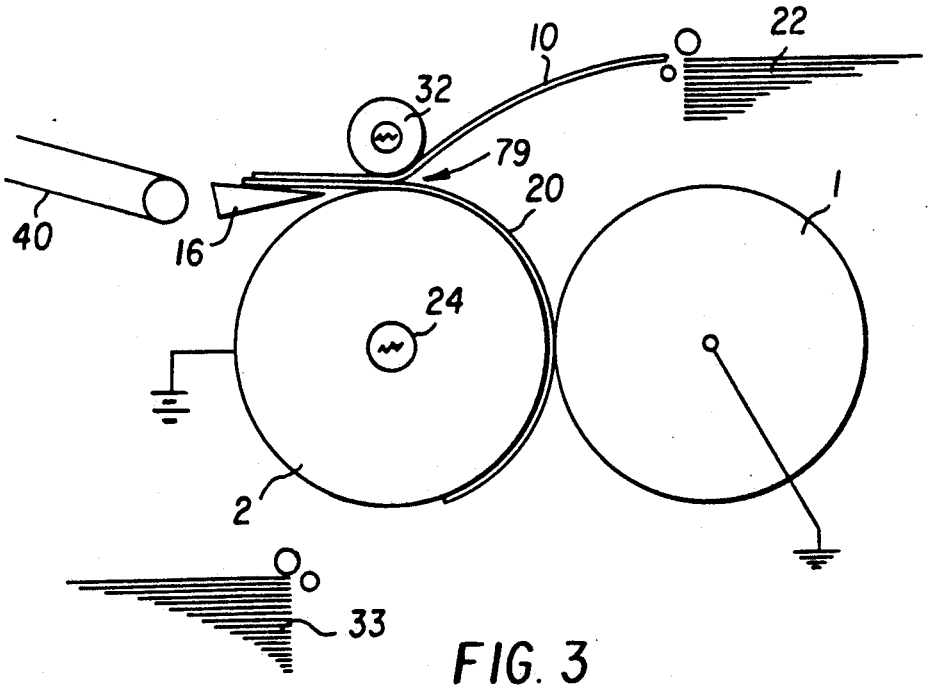

FIG. 3 shows an alternative embodiment of the structure shown in FIG. 1 in which image member 1 and drum 2 are identical in construction and operation with that in FIG. 1. However, the pressure rollers 32 and 34 have been replaced by a single articulatable pressure roller 32 which moves into pressure applying relationship with drum 2 after all images have been transferred to intermediate sheet 20.

More specifically, as the leading edge of intermediate sheet 20 leaves the transfer nip with image member 1 after the final single color image has been transferred to it producing the desired multicolor image, it approaches nip 79 established between drum 2 and heated pressure roller 32. A receiving sheet 10 is fed from receiving sheet supply 22 into overlying relation with the toner image as it enters nip 79. As the leading edge of receiving sheet 10 reaches the center of nip 79, pressure roller 32 is moved toward drum 2 with sufficient force to fuse the multicolor toner image to receiving sheet 10 as in the FIG. 1 embodiment. Again, receiving sheet 10 is preferably preheated by a suitable shoe or heated rollers, especially if receiving sheet 10 has a thermoplastic outer layer. The sandwich of intermediate sheet 20 and receiving sheet 10 is separated by articulatable skive 15 as in FIG. 1 and transported for cooling and separation by transport 40, also as in FIG. 1.

This embodiment has the advantage of fewer parts and more compactness. It also further conserves heat since intermediate sheet 20 has had no chance to cool by leaving drum 2 at all before the fusing step as in FIG. 1. For highest quality work with this embodiment, care must be taken to not disturb an exposure operation on image member 1 in creating further electrostatic images when articulatable heated roller 32 is moved into contact with receiving sheet 10. Although this can be accommodated by beginning the exposure of the next image after roller 32 is applying pressure to the receiving and intermediate sheets, movement of roller 32 away from drum 2 at the completion of the fixing may also have an effect on such exposure. Again, careful timing can prevent a injurious affect on the electrostatic image; for more details for such high-quality work, see U.S. Pat. No. 5,021,835, mentioned above.

Figure 4:
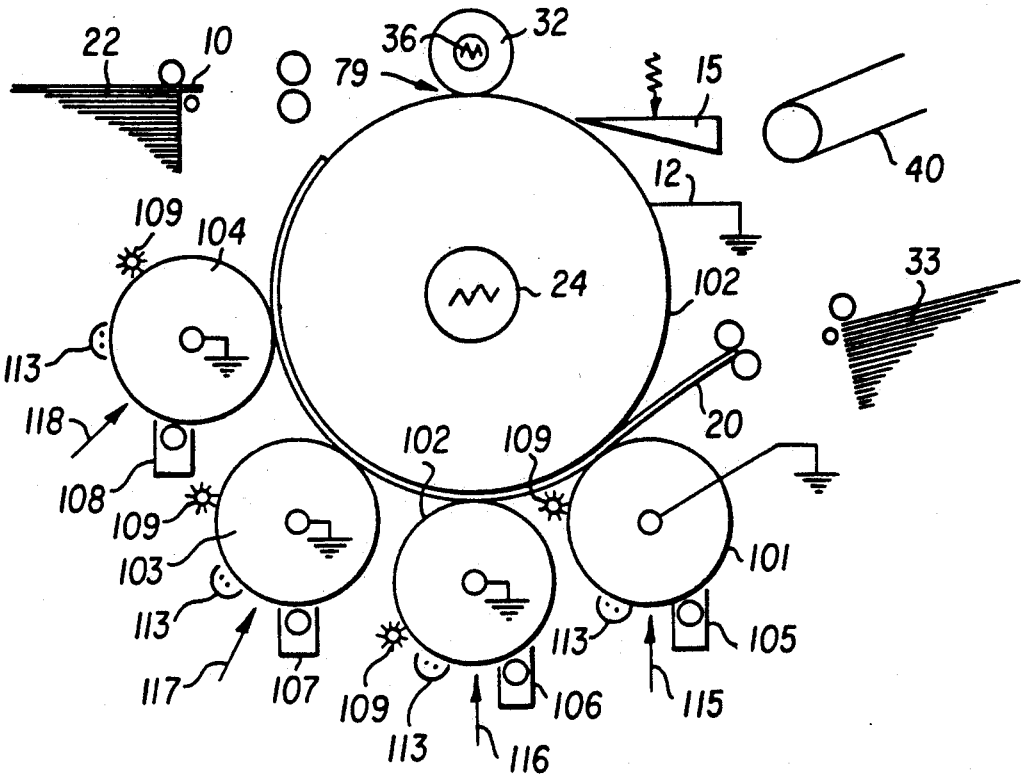
FIGS. 3, 4 and 5 are side schematics of alternative image forming apparatus.

FIG. 4 shows still another embodiment similar to the structure shown in FIGS. 1-3. In FIG. 4 image member 1 has been replaced by four image members 101, 102, 103 and 104, known generally in the art. Each of these image members can have a photoconductive outer surface or other means for forming electrostatic images. As shown in FIG. 4, each of the image members is uniformly charged by charging device 113 and is exposed by a suitable exposure device, for example, lasers 115, 116, 117 and 118 to create a single electrostatic image on each image member. Each electrostatic image is toned by one of toning stations 105, 106, 107 and 108. Each of the toning stations contains a different color toner to provide a different color toner image on each image member. The image members are continuously cleaned before charging by suitable cleaning devices 109.

Image member 1 is continuously cleaned by a suitable cleaning device 9.

An intermediate sheet 20 which is the same as the intermediate sheets used in FIGS. 1-3 is fed from intermediate supply 33 onto a large transfer drum 102 where it is held by vacuum, gripping fingers, or other suitable means. As in FIGS. 1-3, intermediate sheet 20 is heated by a lamp 24 inside transfer drum 102 to a temperature sufficient to raise the temperature of the toner images on each of the image members above their glass transition temperatures at least where the toner particles contact intermediate sheet 20 or each other. Transfer is further assisted by an electrostatic field between intermediate sheet 20 through drum 102 from voltage source 12. As in FIGS. 1-3, some width of the nips can be obtained by compliant backing layers on image members 101 through 104.

Each of the different color toner images are transferred from their respective image members to the outside surface of intermediate sheet 20 in registration to form a multicolor image. The multicolor image is then transferred and fixed to a receiving sheet 10 fed from receiving sheet supply 22 into overlying relation with the image on intermediate sheet 20 by heated pressure roller 32 substantially as in the FIG. 3 embodiment. The receiving and intermediate sheets are separated from drum 102 as a sandwich by permanent skive 15 and picked up by transport device 40 as in FIG. 3.

This embodiment creates a three or four color image on less than a single revolution of drum 102 and can therefore be four times as fast as the FIGS. 1-3 structure. It has the known disadvantage of more difficulty in maintaining registration between images for highest quality work compared to the single transfer position embodiment shown in FIGS. 1-3. As with the other embodiments, for highest quality work, receiving sheet 10 has a heat-softenable outer layer. Although it is not absolutely necessary that pressure roller 32 be articulatable, it is still preferred for best overlaying of the leading edges of the sheets.

Figure 5:
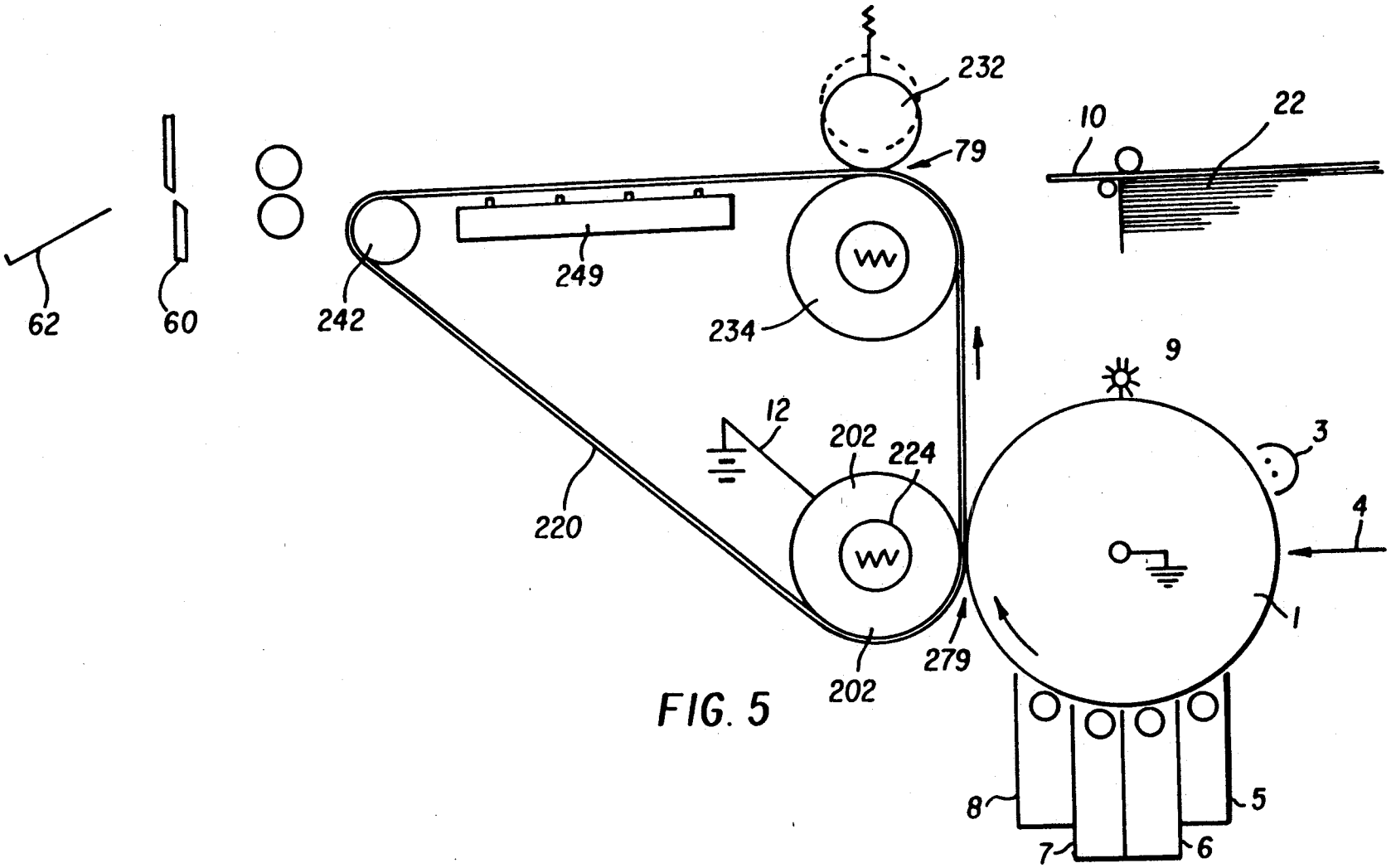

FIG. 5 illustrates use of an endless belt intermediate which does not have the advantages of separate intermediate sheets illustrated in FIGS. 1-4, but can utilize the advantages of a conductive intermediate with electrostatic and heat assisted transfer. Like the FIGS. 1-4 embodiments, it illustrates the transfer process to be described below. Since it does not include a separate intermediate sheet, it is useful for comparison purposes only with respect to that feature.

According to FIG. 5, image member 1 is constructed as in FIG. 1 and creates a series of different color single color toner images. These images are transferred in registration to an intermediate 220 which is an endless belt made of electroformed nickel. The nickel surface can be covered with a very thin layer of a suitable silicone or fluoride to enhance its release capabilities. The single color toner images are transferred in registration to intermediate 220 under the influence of an electric field from a source of potential 12 and after being heated by contact with intermediate 220. The transfer is performed in a nip 279 between intermediate 220 and image member 1 where image member 220 is backed by a metallic roller 202 having a lamp 224 for heating both roller 202 and intermediate belt 220. A multicolor image is formed on intermediate belt 220 which is transferred at a second roller 234 to receiving sheet 10 fed from receiving sheet supply 22. Receiving sheet 10 is pressed by a pressure roller 232 against intermediate 220 where intermediate 220 is backed by roller 234. Pressure roller 232 is articulatable toward roller 234 after the multicolor image has been formed on intermediate belt 220. Receiving sheet 10 maintains contact with intermediate belt 220 while it is cooled by forced air cooling mechanism 249 along a flat section of the belt travel. The belt is passed around a small roller 242 after the image is sufficiently cool for separation from intermediate belt 220, at which point the stiffness of receiving sheet 10 causes it to separate and pass onto cutter 60 and output tray 62.

Because the cooling section must be of substantial size, this embodiment is not nearly so compact as that of FIGS. 1-4. Thus, belt 220 may be too large for efficiency with single multicolor images. Accordingly, several multicolor images can be made at the same time by, for example, making two or three images of the same color at a time and placing two or three images on belt 220 before the next three images of a different color are formed and transferred to belt 220. Belt 220 would then be, for example, two images in length. Alternatively, belt 220 could be one or two ledger-size images in length and two or four letter-sized images in length and operate at full efficiency in each mode; see, for example, U.S. Pat. No. 4,712,906, Bothner et al.

Again, for highest quality work, receiving sheet 10 can have a thermoplastic outer layer which improves both resolution and gloss in the final image.

Further details and examples of the process of transfer from the image member 1 to the conductive intermediates of all FIGS. will now be explained. The apparatus described with respect to FIGS. 1-4 can be used with any hard, smooth surfaced intermediate and with any size toner and still obtain many of the advantages described therein. However, for highest quality work with extremely small toners, a particular transfer process and intermediate is preferred. More specifically, this preferred process is especially usable for transferring toner particles of 5 microns mean diameter or less.

In attempting to transfer extremely small toners, best results have been achieved in the past by transferring directly to a receiving sheet having a heat-softenable outer layer using heat assisted transfer. In this process the outer layer is softened as part of the transfer process and the initial layer or layers of toner partially embed in the heat-softenable layer as part of the transfer process. Subsequent layers are also embedded or fused where the particles touch particles that are, in fact, embedded and also transferred. Although this process is successful over a range of pressures, for highest quality work, quite high pressures are required. For example, transferring four toner images of 3.5 micron toner, depending on the glass transition temperatures of the toner and the thermoplastic layer, may require a pressure of 500 pounds per square inch.

At the same time, the temperature of the heat softenable layer cannot be allowed to get too hot for risk of injury to the photoconductor from which it is being transferred. Also, the toner may get hot where it contacts the photoconductor and fuse to the photoconductor ruining transfer efficiency. Controlling the temperature is challenging through a receiving sheet which also contains a certain amount of moisture. The moisture can turn into steam if the temperature gets above 100° C. and blister the sheet while if the temperature is much below 100° C., consistent softening of the thermoplastic layer is difficult to achieve. Preheating the photoconductor can help, but it can only be heated to a temperature that does not damage it.

Using an intermediate which is highly thermally conductive, for example, one made entirely of nickel or of nickel coated stainless steel, requires less energy to heat than a receiving sheet with lower thermal conductivity. Its temperature is much easier to control. However, because the conductive intermediate does not have the affinity for toner that a softened thermoplastic coated receiving sheet has, transfer of the first layer or layers is somewhat more difficult. However, if a thermally and electrically conductive intermediate is used which is heated high enough to heat the toner it touches to its glass transition temperature and an electrical field is also impressed between the intermediate and the image member, transfer efficiency comparable to that with thermoplastic coated receivers is obtained. With most toners, transfer efficiencies of 90–96% are obtained. With some toners, transfer efficiencies of 99% and higher are obtained.

In addition to greater temperature control, these transfers are obtained at pressures as low as 50 pounds per square inch and lower with a quality comparable to that with the thermoplastic coated receiver at 600 pounds per square inch. This provides substantial improvement in the life of the image member as well as making manufacture and design of apparatus easier. In highest quality work, the high pressure transfer is more susceptible to perturbations that could alter the motion of the image member during exposure adversely affecting an image.

Largely because of the higher thermal conductivity and the ease of control of the temperature, far less energy need be used at the first transfer. For example, using a toner with a glass transition temperature of 66° C., good transfer is effected with an intermediate belt at 70° C. This compares favorably with thermoplastic coated receiver transfer in which a drum is heated to 110°–120° C. to get the same sintering of the toner through a receiver sheet.

Although stainless steel, nickel and aluminum and other metals are preferred for the intermediate, they may be covered with a very thin layer of a conductive release material which has sufficient carbon or other particles in it to make it both heat and electrically conductive. Materials suitable as surface treatments for metal intermediates include low surface energy polymers such as silicones and fluoropolymers containing metal salts as filler particles, like aluminum oxide and carbon, and metal/polymer alloys such as electrodeposited nickel/fluoropolymer coatings. In general, as shown by the examples below, remarkable results are achieved without such release materials.

This particular process is especially useful in transferring toner particles less than 5 microns in mean particle diameter, because such toner particles are virtually impossible to transfer with high efficiency using an electric field alone. As described above, this is due to greater effect on small particles of van der Waals and other similar adhesive forces than the force from an electric field. For that reason, some sort of heat assist is necessary with such fine particles. The electric field appears to substitute for the thermoplastic layer on the receiver of the prior heat assisted systems, with the substantial improvements noted.

The following examples illustrate the transfer efficiencies and their sensitivity (or lack thereof) to pressure, temperature and type of toner. Note that while some minimum pressure may be necessary, the actual magnitude does not appear to be important. Note also that although any temperature above the glass transition temperature for the toner would provide good transfer of some toner, temperatures much above such glass transition temperature would adversely affect most photoconductors and cause some toner to stick to the image member. Note, also, the substantial positive effect of the electric field.

EXAMPLES

In all of the following examples an aluminum drum was covered first with a 33 mil thick polycarbonate sheet of 87 shore A hardness and then with an inverse composite organic photoconductor element. The photoconductor element included conventional conductive and photoconductive layers on a support. The photoconductive layers were charged to between −400 and −450 volts and exposed for two seconds through a 0.7 neutral density filter. The discharged areas of the photoconductor were toned with a magnetic brush at a bias of 45 volts with positively charged cyan toner. Three cyan toner images so formed were transferred on top of each other to a nickel sheet wrapped around a metallic drum. The examples were repeated under varying heat, pressure, and electric field conditions. The results are tabulated as follows:

| EXAM. | TONER | TRANS. DRUM TEMP. °C. | ELECTRIC FIELD IN VOLTS | TRANS. # | PLI | % TRANS. |
|---|---|---|---|---|---|---|
| 1 | #1 | 100 | −400 | 1 | 30 | 93 |
| | | 100 | −400 | 2 | 30 | 92 |
| | | 100 | −400 | 3 | 30 | 91 |
| 2 | #1 | 100 | −400 | 1 | 30 | 95 |
| | | 105 | −400 | 2 | 30 | 97 |
| | | 110 | −400 | 3 | 30 | 93 |
| 3 | #2 | 100 | −400 | 1 | 30 | 95 |
| | | 100 | −400 | 2 | 30 | 97 |
| | | 100 | −400 | 3 | 30 | 99 |
| 4 | #2 | 100 | 0 | 1 | 30 | 93 |
| | | 100 | 0 | 2 | 30 | 93 |
| | | 100 | 0 | 3 | 30 | 94 |
| 5 | #3 | 100 | −400 | 1 | 30 | 97 |
| | | 100 | −400 | 2 | 30 | 96 |
| | | 100 | −400 | 3 | 30 | 95 |
| 6 | #2 | 70 | −450 | 1 | 30 | 100 |
| | | 70 | −450 | 2 | 30 | 99 |
| | | 70 | −450 | 3 | 30 | 98 |
| 7 | #2 | 80 | −450 | 1 | 30 | 99 |
| | | 80 | −450 | 2 | 30 | 99 |
| | | 80 | −450 | 3 | 30 | 99 |
| 8 | #2 | 90 | −450 | 1 | 30 | 99 |
| | | 90 | −450 | 2 | 30 | 99 |
| | | 90 | −450 | 3 | 30 | 99 |
| 9 | #2 | 100 | −450 | 1 | 30 | 99 |
| | | 100 | −450 | 2 | 30 | 99 |
| | | 100 | −450 | 3 | 30 | 99 |
| 10 | #2 | 90 | 0 | 1 | 30 | 94 |
| | | 90 | 0 | 2 | 30 | 93 |
| | | 90 | 0 | 3 | 30 | 90 |
| 11 | #4 | 90 | −450 | 1 | 30 | 97 |
| | | 90 | −450 | 2 | 30 | 96 |
| | | 90 | −450 | 3 | 30 | 93 |
| 12 | #2 | 80 | −450 | 1 | 15 | 99 |
| | | 80 | −450 | 2 | 15 | 98 |
| | | 80 | −450 | 3 | 15 | 97 |
| 13 | #2 | 80 | −450 | 1 | 20 | 98 |
| | | 80 | −450 | 2 | 20 | 99 |
| | | 80 | −450 | 3 | 20 | 99 |
| 14 | #2 | 80 | −450 | 1 | 25 | 99 |
| | | 80 | −450 | 2 | 25 | 100 |
| | | 80 | −450 | 3 | 25 | 99 |

-continued

| EX-AM. | TONER | TRANS. DRUM TEMP. °C. | ELEC-TRIC FIELD IN VOLTS | TRANS. # | PLI | % TRANS. |
|---|---|---|---|---|---|---|
| 15 | #2 | 80 | −450 | 1 | 30 | 99 |
| | | 80 | −450 | 2 | 30 | 99 |
| | | 80 | −450 | 3 | 30 | 99 |

The pressure is given in pounds per linear inch. A pressure of 20 pounds per linear inch corresponds roughly to a peak pressure of 200 pounds per square inch in such a nip. The electrical field is created by biasing the metallic transfer drum and grounding the conductive layer of the photoconductive element. The toners are

#1 A limited coalescence latex toner having a mean diameter of 3.8 microns in a milled Piccotoner 1221 binder.

#2 A limited coalescence toner having a mean diameter of 3.5 microns in a Piccotoner 1221 binder with a silica surface treatment. (This toner is further described with respect to examples 16–24.)

#3 A limited coalescence latex toner having a mean diameter of 3.5 microns with a low molecular weight polystyrene binder.

#4 Same as #2 without silica coating.

The percent of toner transferred was measured by transferring both the transferred image(s) and the residual image on the photoconductor to separate receiving sheets. The reflection density of the images on the receiving sheets was measured by an X-rite densitometer and compared.

An additional set of examples, 16–24, were run in which only a single toner transfer was done and measured by the same procedure, illustrating two additional toners, each with different coatings and compared to toner #2.

| Example | Toner | Temperatures °C. | % Transfer |
|---|---|---|---|
| 16 | 2 | 70 | 99 |
| 17 | 5 | 70 | 97 |
| 18 | 6 | 70 | 95 |
| 19 | 2 | 80 | 99 |
| 20 | 5 | 80 | 98 |
| 21 | 6 | 80 | 94 |
| 22 | 2 | 90 | 99 |
| 23 | 5 | 90 | 98 |
| 24 | 6 | 90 | 95 |

Examples 16–24 were all carried out with a field of −450 volts, pressure of 20 pounds per linear inch and at 4 inches per second.

Toners #2, 5 and 6 are powder compositions which comprise core particles of small particle size that are coated with minute transfer-assisting particles of colloidal silica, colloidal polymer or colloidal alumina. The core particles, of which a thermoplastic binder polymer is the major component, are pigmented and contain an ionic charge control agent. The transfer-assisting particles can be from 0.01 to 0.2 microns in size and are uniformly distributed upon the surface of the toner. They are the subject of cofiled patent application Ser. No. 07/843,587, filed Feb. 28, 1992, now abandoned.

Preferably, the binder polymer is a low molecular weight styrene-butyl acrylate copolymer, such as Piccotoner 1221* polymer supplied by Hercules Co. The pigment is bridged aluminum phthalocyanine. The core particles of 3.5 microns average diameter are made by the evaporative limited coalescence process disclosed in U.S. Pat. No. 4,833,060, which patent is incorporated herein by reference.

The core particles of the toner have an overcoat which makes up about 3 wt. % of the coated particles and which is formed by coating the particles with an aqueous dispersion of the selected colloidal-size material. Following are examples of useful procedures and materials for coating the core particles.

Toner #2—To a 40-g portion of the core toner particles in a blender is added dropwise 29.2 g of an aqueous colloidal dispersion of silica containing 4% solids by weight. The latter is prepared by dilution of Nalcoag 1060* silica, a 50% by weight dispersion of silica having an average particle size of about 0.060 microns. After agitation for about 30 min., the coated toner is dried at room temperature.

Toner #5—A 40-g portion of core toner particles in a blender is treated with a mixture of 50 g of a monodisperse latex of styrene-sodium styrenesulfonate copolymer (2.4% solids by weight; average particle size about 0.1 microns) and 7 g of water. After brief further agitation, the coated toner is dried for 30 min. under vacuum in a microwave oven at 30% power to prevent fusion of the toner particles.

Toner #6—As in Toner #2 above, 24 g of an aqueous dispersion of aluminum oxide containing 5% solids by weight (Aluminum Oxid C*, from Degussa Corp.) diluted with 16 g of water is added to 40 g of the core toner particles in a blender. After brief further agitation, the coated toner is dried as with Toner #5, above.

From the examples it can be seen that the process gives good results with a variety of toners having a particle size less than 5 microns. It is effective at significantly lower temperatures and pressures than is transfer to a paper or transparency stock receiving sheet even if the receiving sheet is covered with a heat-softenable layer of thermoplastic material using no electrical field.

The highest transfer efficiencies were obtained with toners #2 and 5, especially #2 which provided transfer efficiencies approaching 100. This is a truly remarkable result.

To take fullest advantage of the greater temperature control available with this method, it is preferred that the glass transition temperature of the toners be fairly low, for example, between 55° and 70° C. Good transfer can be obtained less than 10° above this glass transition temperature. Although good transfer can also be obtained at 90° or 100° C., using these higher temperatures is more likely to damage the image member if the temperature is poorly controlled. Toner #2 in the above examples has a glass transition temperature about 60° C. Similarly, although the method will work at higher pressures, there are substantial system advantages to maintaining the pressure below 300 psi and less. The method will work at 100 psi.

In examples 1–15, after the three images were transferred, the nickel sheet was removed, overlaid with a high quality laser print paper receiving sheet and fed by hand through a pair of fusing rollers, both of which were heated. The sheets were allowed to cool and were then separated with the three images stored in overlapping relation on the receiving sheet. Measurements to determine transfer efficiency were done with these images.

The transfer of the multicolor image formed on the intermediate to the receiving sheet is similar to transfusing or transfixing processes in the prior art. For ordinary transfer to a paper receiving sheet, ordinary fusing temperatures and pressures can be used.

As mentioned above, it is best to allow the toner image to cool before separation from the intermediate. This eliminates the need for release oils which can interfere with highest quality transfer from the image member and adversely affect the image.

If highest quality work is to be done, the second transfer is best made to a receiving sheet having a heat-softenable thermoplastic outer layer. Preferably, that layer is preheated to its softening point. Higher pressures are desired than with ordinary fusing, for example, pressures substantially in excess of 100 pounds per square inch. Again, for highest quality images, the receiving sheet and the intermediate should be left in contact until both the image and the thermoplastic layer have cooled below their softening temperatures, as shown in FIGS. 1-5.

The invention has been described in detail with particular reference to a preferred embodiment thereof, but it will be understood that variations and modifications can be effected within the spirit and scope of the invention as described hereinabove and as defined in the appended claims.

We claim:

1. A method of forming a toner image made up of small toner particles, said method comprising:

forming a toner image on an image member, and transferring said toner image to a transfer surface of a thermally and electrically conductive intermediate member by heating said transfer surface while pressure contacting said transfer surface with said toner image on said image member with pressure between the transfer surface and the image member of not more than 300 pounds per square inch in the presence of an electric field of a direction urging said toner image to transfer to said transfer surface, said transfer surface being heated to a temperature sufficient to sinter the toner particles at least where they touch the transfer surface and touch each other but insufficient to damage the image member or cause the toner to stick to the image member.

2. The method according to claim 1 wherein said intermediate member is metallic.

3. The method according to claim 1 wherein said intermediate is substantially metallic and has a thin release coating on the transfer surface.

4. The method according to claim 1 wherein said toner particles have a mean diameter of less than 5 microns.

5. The method according to claim 4 wherein said toner particles have a mean diameter of approximately 3.5 microns.

6. The method according to claim 1 wherein said intermediate member is heated to a temperature greater than the glass transition temperature of said toner but less than 100 degrees C.

7. The method according to claim 1 wherein said intermediate member is heated to a temperature between the glass transition temperature of said toner and 10 degrees C. above such glass transition temperature.

8. A method of forming a toner image made up of small toner particles, said method comprising:

forming a toner image on an image member, and transferring said toner image to a transfer surface of a thermally and electrically conductive intermediate member by heating said transfer surface while pressure contacting said transfer surface with said toner image on said image member in the presence of an electric field of a direction urging said toner image to transfer to said transfer surface, said transfer surface being heated to a temperature greater than the glass transition temperature of said toner but less than 100° C. and sufficient to sinter the toner particles at least where they touch the transfer surface and touch each other but insufficient to damage the image member or cause the toner to stick to the image member.

9. The method according to claim 8 wherein said intermediate member is heated to a temperature between the glass transition temperature of said toner and 10 degrees C. above such glass transition temperature.

10. The method according to claim 1 further including the step of transferring said toner image from said intermediate member to a receiving sheet by a combination of heat and pressure sufficient to fix said toner image to said receiving sheet.

11. A method of forming a multicolor toner image made up of small toner particles on a receiving sheet, said method comprising:

forming a series of single color toner images on one or more image members, transferring said toner images, in registration, to a transfer surface of a thermally and electrically conductive intermediate member to form a multicolor image on said transfer surface by heating said transfer surface while pressure contacting said transfer surface with said toner images on said image member with pressure between the transfer surface and the image member of not more than 300 pounds per square inch in the presence of an electric field of a direction urging said toner images to transfer to said transfer surface, said transfer surface being heated to a temperature sufficient to sinter the toner particles at least where they touch the transfer surface and touch each other but insufficient to damage the image member or cause the toner to stick to the image member, and transferring said multicolor toner image from said transfer surface to a receiving sheet.

12. The method according to claim 11 wherein said intermediate member is metallic.

13. The method according to claim 11 wherein said intermediate is substantially metallic and has a thin release coating on the transfer surface.

14. The method according to claim 11 wherein said toner particles have a mean diameter of less than 5 microns.

15. The method according to claim 14 wherein said toner particles have a mean diameter of approximately 3.5 microns.

16. The method according to claim 11 wherein said intermediate member is heated to a temperature greater than the glass transition temperature of said toner but less than 100 degrees C.

17. The method according to claim 11 wherein said intermediate member is heated to a temperature between the glass transition temperature of said toner and 10 degrees C. above such glass transition temperature.

18. A method of forming a multicolor toner image made up of small toner particles on a receiving sheet, said method comprising:

forming a series of single color toner images on one or more image members, transferring said toner images, in registration, to a transfer surface of a thermally and electrically conductive intermediate member to form a multicolor image on said transfer surface by heating said transfer surface while pressure contacting said transfer surface with said toner images on said image member in the presence of an electric field of a direction urging said toner images to transfer to said transfer surface, said transfer surface being heated to a temperature greater than the glass transition temperature of said toner but less than 100° C. and sufficient to sinter the toner particles at least where they touch the transfer surface and touch each other but insufficient to damage the image member or cause the toner to stick to the image member, and transferring said multicolor toner image from said transfer surface to a receiving sheet.

19. The method according to claim 18 wherein said intermediate member is heated to a temperature between the glass transition temperature of said toner and 10 degrees C. above such glass transition temperature.

20. The method according to claim 11 wherein the step of transferring said multicolor toner image to a receiving sheet is accomplished by contacting a heat softenable layer of a receiving sheet with said toner image with sufficient heat and pressure to fix said toner image to said heat softenable layer.

21. A method of forming a multicolor toner image made up of small toner particles on a receiving sheet, said method comprising:

forming a plurality of electrostatic images on one or more image members, applying toner particles having a mean diameter less than 5 microns to each of said electrostatic images, the toner particles applied to each image being of a color different than that applied to the other images, to form a plurality of single color toner images, transferring said toner images, in registration, to a transfer surface of a metallic intermediate member to form a multicolor image on said transfer surface by heating said transfer surface through the intermediate member while contacting said transfer surface with said toner images on said one or more image members in the presence of an electric field of a direction urging said toner images to transfer to said transfer surface, said transfer surface being heated to a temperature sufficient to sinter the toner particles at least where they touch the transfer surface and touch each other but insufficient to damage the one or more image members or cause the toner to stick to the one or more image members, and transferring said multicolor toner image from said transfer surface to a receiving sheet.

22. The method according to claim 21 wherein at least one of said toner images is made up of a toner including a surface coating of minute transfer assisting particles.

23. The method according to claim 22 wherein said transfer assisting particles are colloidial silica deposited out of an aqueous dispersion.

24. The method according to claim 23 wherein said transfer assisting particles have an mean diameter of about 0.06 microns.

25. The method according to claim 22 wherein said transfer assisting particles are polymeric particles deposited out of an aqueous solution.

26. The method according to claim 25 wherein said transfer assisting particles have an mean diameter of about 0.1 microns.

27. The method according to claim 22 wherein said transfer assisting particles are colloidial alumina deposited out of an aqueous dispersion.

28. The method according to claim 22 wherein each of said toner images is made up of a toner including a surface coating of minute transfer assisting particles.

29. The method according to claim 21 wherein said toners have a glass transition temperature of between 55 and 70 degrees C. and said intermediate member is heated to a temperature between the glass transition temperature of the toner and 10 degrees C. above said glass transition temperature.

30. Apparatus for forming a multicolor toner image made up of small toner particles on a receiving sheet, said apparatus comprising:

means for forming a series of single color toner images on one or more image members, a thermally conductive intermediate member having a hard smooth transfer surface, means for transferring said toner images, in registration, to said transfer surface to form a multicolor image on said transfer surface said transfer means including means for contacting said toner images on said image member, means for heating said transfer surface to a temperature sufficient to sinter the toner particles at least where they touch the transfer surface and touch each other but insufficient to damage the image member or cause the toner to stick to the image member, means for establishing an electric field of a direction urging said toner images to transfer to said transfer surface, and means for transferring said multicolor toner image from said transfer surface to a receiving sheet.

31. Apparatus according to claim 30 wherein said intermediate is a metallic web or sheet backed by an internally heated metallic roller.

32. Apparatus according to claim 30 wherein said image member includes a thin compliant layer.

33. Apparatus according to claim 31 wherein said image member includes a thin compliant layer.

34. Apparatus according to claim 30 wherein said means for transferring said multicolor image includes means for applying sufficient heat and pressure to said intermediate member and said receiving sheet to fix said image to said receiving sheet.

35. In a method of forming a multicolor image, said method comprising:

forming a series of different color, single color toner images on one or more image members, and transferring the toner images from the image members to an intermediate member in registration to form a multicolor image, the improvement wherein said intermediate member has a hard, smooth, conductive surface and said step of transferring toner images to the intermediate member includes heating said intermediate member to at least the glass transition temperature of the toner images and contacting said toner images with said hard, smooth conductive surface in the presence of an electric field urging transfer of said toner images to said surface.

* * * * *